United States Patent [19]

Medlock

[11] Patent Number: 4,984,805

[45] Date of Patent: Jan. 15, 1991

[54] EDUCATIONAL BOARD GAME AND METHOD OF PLAYING THE SAME

[76] Inventor: Nancy P. Medlock, 2647 N. 22nd St., Kansas City, Kans. 66104

[21] Appl. No.: 470,694

[22] Filed: Jan. 26, 1990

[51] Int. Cl.[5] ..... A63F 3/00; A63F 9/18

[52] U.S. Cl. ..... 273/248; 273/141 R; 273/282

[58] Field of Search ..... 273/242, 249, 248, 243, 273/141 R, 282

[56] References Cited

U.S. PATENT DOCUMENTS

| | | | |
|---|---|---|---|
| 1,635,735 | 7/1927 | Ziegler | 273/249 |
| 2,006,176 | 6/1935 | Quine | 273/248 |
| 4,090,717 | 5/1978 | Rossetti | 273/249 |
| 4,315,627 | 2/1982 | Schlegel et al. | 273/249 |
| 4,487,418 | 12/1984 | Allen | 273/242 |
| 4,856,780 | 8/1989 | Begley et al. | 273/244 |
| 4,884,815 | 12/1989 | Glenn | 273/240 |

FOREIGN PATENT DOCUMENTS

| | | | |
|---|---|---|---|
| 2198361 | 6/1988 | United Kingdom | 273/249 |

*Primary Examiner*—Benjamin Layno

*Attorney, Agent, or Firm*—Hovey, Williams, Timmons & Collins

[57] ABSTRACT

An educational board game and method of playing the same is provided which includes a game board presenting a plurality of answering player locations, a questioning player location, a plurality of start to finish paths, one for each player, a marker token for each player, a random question and answer selector for selecting a question and answer category, and a set of question and answer cards having questions and answers written thereon corresponding to different categories displayed on the selector. The game further includes a plurality of interchangeable selector faces, each face representing a different group of category indicia. The game also includes a plurality of sets of question and answer cards corresponding to the interchangeable selector faces. The game hereof also preferably includes a die or other chance generator for determining the order of play and a timer for limiting the interval for a player to respond to a question. The method of playing the game includes selecting a question and answer card, spinning the question and answer selector to randomly determine the category to be asked, asking the question displayed on the card corresponding to the category, answering the question, and advancing or retreating the marker token along the player's own path depending on the correctness of the answer.

10 Claims, 2 Drawing Sheets

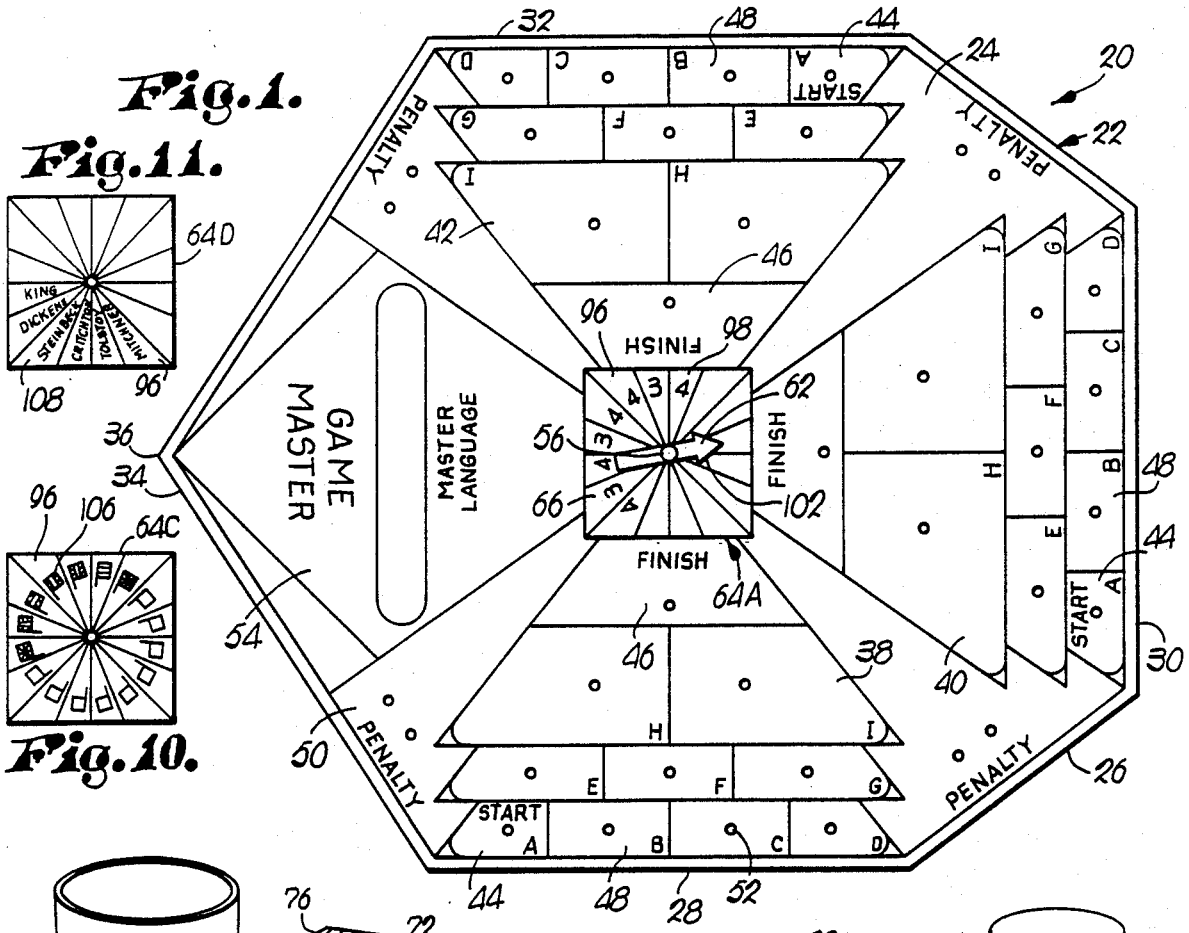
Fig. 1.
Fig. 11.
Fig. 10.
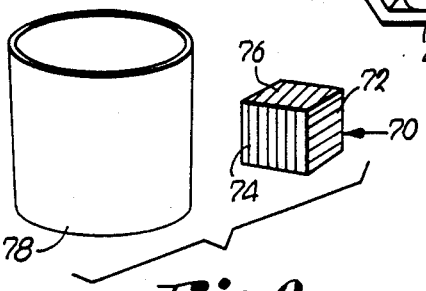
Fig. 2.
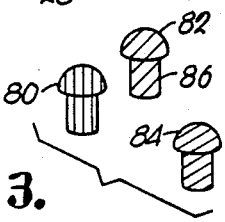
Fig. 3.
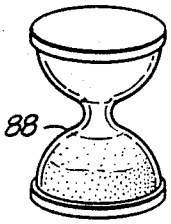
Fig. 4.
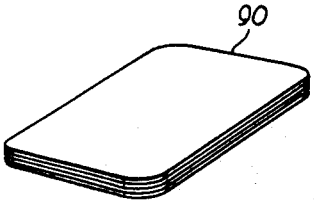
Fig. 5.
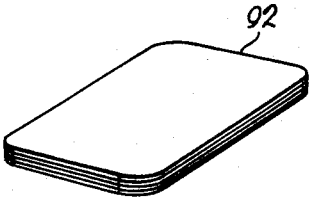
Fig. 6.
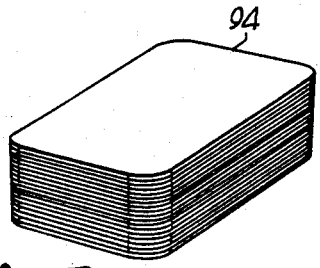
Fig. 7.
Fig. 8.
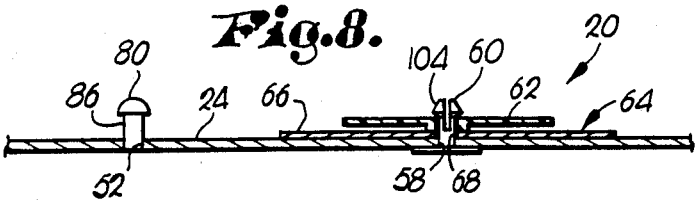
Fig. 9.
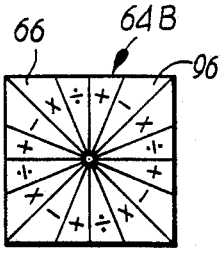

FIG. 12.

94a

| D - 3 | 103 |
|---|---|
| small amount | dab |
| father | dad |
| not night | day |
| animal lair | den |
| D - 4 | |
| skillful | deft |
| oppose authority | defy |
| short valley | dell |
| hollow mark | dent |
| disown | deny |

FIG. 13.

94b

| + | 103 |
|---|---|
| 18 + 22 | = 40 |
| 24 + 39 | = 63 |
| − | |
| 13 − 9 | = 4 |
| 41 − 8 | = 33 |
| x | |
| 10 x 9 | = 90 |
| 11 x 11 | = 121 |
| ÷ | |
| 44 ÷ 4 | = 11 |
| 81 ÷ 9 | = 9 |

FIG. 14.

94c

| 103 | |
|---|---|
| English | Who? |
| French | Qui? |
| Spanish | Quien? |
| Italian | Chi? |
| German | Wer? |

FIG. 15.

94d

| TITLE -3 | 103 |
|---|---|
| Dickens | Christmas Carol, A |
| Mitchner | Caravans<br>Centennial<br>Chesapeake<br>The Covenant |
| Steinbeck | Cannery Row |
| Tolstoy | Childhood, Brotherhood and Youth |
| Crichton | Coma |
| King | Carrie |
| Wouk | The Caine Mutiny |

EDUCATIONAL BOARD GAME AND METHOD OF PLAYING THE SAME

BACKGROUND OF THE INVENTION

1. Field of the Invention

This invention relates to an educational board game useful in teaching students a variety of subject matters in an environment which is recreational in character. More particularly, it pertains to a board game in which competitive answering players seek to become the game master by correctly responding to randomly selected questions along respective paths, the game also including marker tokens for indicating each student's progress along his or her respective path, a timer for limiting the response time allotted to answer each question, and preferably a plurality of interchangeable selector fields, each field having a face displaying a group of related categories, each group corresponding to a particular set of question and answer cards.

2. Description of the Prior Art

A variety of different board games have heretofore been known which have, as an object thereof, winning of the game by successfully answering questions asked by fellow players. Such games however, are often protracted and slow moving, thus losing the interest of younger participants who desire a quick progression from start to finish. Yet further, they lack a visible goal whereby successful responses to the question places the "winner" in a leadership position of being the questioner for further rounds of the game. Yet further, prior games have not heretofore provided devices or methods for teaching self control of small participants by imposing penalties for failure to wait for their respective turns. Finally, prior games have not been readily adaptable for use of the same game board with a variety of different question and answer selectors whereby questions in different category groups may be readily substituted.

SUMMARY OF THE INVENTION

The present game and method of playing the same is thus directed to providing an educational board game whereby players or teams of players may compete along individual paths to progress from a start area to a finish area and thus become the game master. The present game thus provides a recreational and competitive environment whereby students may act as players in the game while reinforcing or adding to their own knowledge of various categories. In particular, the game board is preferably laid out to present three separate paths along which players or teams of players may progress from a start to a finish, while a visually distinguishable end portion is reserved for the game master who will ask the questions to the other players or teams of players.

A marker token corresponds to each player or teams of players, which indicates the players' progression along their respective paths from start to finish. In addition, the game may include a penalty area for each player or team of players whereby a player who answers out of turn may be placed in the penalty area with a corresponding loss of his or her turn, and then returned to the start in order to emphasize the need for self control and respecting the rights of others.

The game hereof includes a random question and answer selector, for choosing among different categories of questions to be asked. A different region is designated on the face of the selector for receiving indicia corresponding to a category question to be asked. The questions themselves are displayed on question and answer cards, which preferably include a question corresponding to each category thereon. Thus, a question and answer card may be selected by the game master, responsible for asking the questions, whereafter an answering player actuates the indicator of the selector to determine the category of question to be asked. Upon correctly responding to the question, the answering player advances a marker token toward the finish area, but incorrect answers result in the player losing his or her turn. The game may also include a scattering of penalty cards and bonus cards enabling the answering player to avoid the question and advance upon receipt of a bonus card, but move backwards upon receipt of a penalty card. The game also preferably includes a die or other chance generator whereby the order of play among the players may be randomly determined, and a timer for limiting the interval during which a player may respond to a question.

In particularly preferred embodiments, the game board hereof includes a spindle which may be removed from an aperture at the center of the game board, whereby different faces bearing different groups of categories may be displayed. When different category groups are supplied with the game, a different set of question and answer cards will be supplied with each category.

The game is conventionally played by one player assuming the position of game master and the other players assuming positions around the board corresponding to the different paths dispayed thereon. The die is cast and the color displayed on the uppermost side indicates the corresponding color of the player to begin play. The players take successive turns answering questions corresponding to the category indicated by the randomly spun marker, with the player who is first to reach his finish area becoming the game master for the next round. Thereafter, the previous game master assumes the new game master's previous spot, and all tokens are returned to start and the game is repeated. Many variations on the preferred method of play may be employed, whereby the players may master the different groups of categories in both an educational and recreational environment.

BRIEF DESCRIPTION OF THE DRAWING

FIG. 1 is a plan view of the preferred game board of the present invention, showing the end for the game master, the sides for each of the players, and the random category selector at the center of the game board;

FIG. 2 is a perspective view of a cup and die used for selecting the order of play among the answering players;

FIG. 3 is a perspective view of the marker tokens used to indicate the players' progress along a start to finish path of the game board;

FIG. 4 is a representative timer for determining the allotted period for a player to respond to an asked question;

FIG. 5 is a perspective view of a stack of bonus cards;

FIG. 6 is a perspective view of a stack of penalty cards;

FIG. 7 is a perspective view of a stack of question and answer cards which are commonly dimensioned with the penalty cards and the bonus cards;

FIG. 8 is an enlarged, fragmentary sectional view through the center of the selector means showing a removable spindle mounting a rotatable indicator and a selector face, together with a marker token inserted within a recess of the board hereof;

FIG. 9 is a plan view of an alternate selector face used when mathematical, or more particularly arithmetical questions are to be asked;

FIG. 10 is a second alternate random selector face displaying symbols, such as flags, of different nationalities when foreign language questions are to be asked;

FIG. 11 is a third alternate game face displaying the names of authors thereon when literature questions are to be asked;

FIG. 12 is a plan view of an exemplary question and answer card for use in conjunction with the selector face shown in FIG. 1 and used in conjunction with an English language game;

FIG. 13 is a plan view of an exemplary question and answer card used in conjunction with the face shown in FIG. 9 for a mathematical game;

FIG. 14 is a plan view of an exemplary question and answer card for use in conjunction with a selector face appearing in FIG. 10 for use as a foreign language game; and FIG. 15 is a plan view of an exemplary question and answer card used in conjunction with the selector face shown in FIG. 11, when used as an English literature game.

DESCRIPTION OF THE PREFERRED EMBODIMENTS

Referring now to the drawing, an educational board game 20 in accordance with the present invention preferably includes the various components shown in FIGS. 1 through 15 hereof, and is adapted to be used in conjunction with a variety of different groups of categories. The various components are shown in different figures, and together are used in combination for the preferred board game hereof.

Referring now to FIG. 1, a game board 22 is shown and includes a generally flat playing surface 24 on one side thereof. The game board 22 is defined by the surrounding marginal edge 26 which presents three generally linear sides 28, 30 and 32 for seating of an answering player adjacent thereto and an end 34 for seating of a questioning player, also known as the game master. The end 34 is structurally distinguished from the sides and presents a point 36 directed toward the game master.

The game board is also imprinted or inscribed to present a plurality of player progress paths 38, 40 and 42 thereon, with one path 38, 40 and 42 corresponding respectively to each side 28, 30 and 32. Each path 28, 30 and 32 includes a start area 44, a finish area 46, and a plurality of intermediate areas 48. In addition, adjacent each path is a penalty area 50 for purposes as will be described hereinafter. Each start area 44, finish area 46, intermediate area 48 and penalty area 50 is preferably provided with a marker token-receiving recess 52.

In greater detail, the progression of the path is generally indicated by an alphabetical or numerical sequence. For example, as shown in FIG. 1, the sequence of progression of each player along paths 38, 40 or 44 is indicated by the alphabetical sequence beginning with the letter A to indicate start, proceeding alphabetically along each intermediate area 48 indicated by letters B, C, D, E, F, G, H and I, concluding with the final finish area 46. The paths 38–42 may be indicated by any arrangement, but as shown in the preferred embodiment in FIG. 1, are indicated by a sequence of generally overlapping triangular shapes.

The game board 22 also includes a game master region 54 adjacent end 34 for use by the game master in asking questions to players seated at respective sides 28, 30 and 32.

Game board 22 also includes a center 56, which includes structure defining an aperture 58, as shown in FIG. 8. Aperture 58 is adapted to receive a removable spindle 60 therethrough, for demountably engaging a manually manipulable rotatable indicator arrow 62 thereon. A selector card 64 having an upper face 66 and defining a hole 68 in the center thereof is mounted in superposed relationship over playing surface 24 whereby hole 68 lies in registry with aperture 58 of game board 22. As may thus be appreciated, the selector card 64 lies at the center 56 of the game board 22 with face 66 visibly displayed as shown in FIG. 1.

It may be understood that each path 38, 40 and 42 may be of a generally different color for purposes of player identification. Thus, as shown in FIG. 2, a die 70 of generally cubic configuration presenting six separate faces may be provided with three different colors indicated on faces 72, 74 and 76, with the understanding that the same colors would be repeated on faces not visible from the view shown in FIG. 2. Additionally, a die cup 78 is provided which has a sufficient inner diameter to receive die 70 therein for agitation and rolling of the die 70.

Referring now to FIG. 3, a separate marker token is provided for each answering player, the marker tokens 80, 82 and 84 preferably being colored corresponding to the respective faces 72, 74 and 76 of die 70. Each token is preferably provided with a stem 86 adapted to be received within recess 52 as shown in FIG. 8.

Turning now to FIG. 4, a timer 88 is provided for determining the allowable interval between the asked question and receipt of the response by an answering player. Timer 88 is shown as a conventional hourglass shaped timer, which preferably includes an amount of sand which will pass through the neck in 30 seconds, realizing that other quantities of sand to provide different intervals may be provided. However, a 30 second interval has been found to allow the game to continue moving while nevertheless providing an adequate time for a response from an answering player.

Turning now to FIGS. 5, 6 and 7, a set of bonus cards 90 are shown in FIG. 5 which bear indicia indicating that the recipient of a bonus card is permitted a free advance along that player's path without the necessity of responding to a question. Similarly, penalty cards 92 shown in FIG. 6 are provided which bear indicia indicating that the recipient of the penalty card must move back one space. Bonus cards 90 and penalty cards 92 are generally small in number in relationship to question and answer cards 94 shown in FIG. 7, but are of a common dimension and preferably bear an identical appearance on one face thereof, much in the manner of an ordinary deck of playing cards, whereby when all the cards are faced in a common direction, the bonus cards 90, penalty cards 92, and question and answer cards 94 are virtually indistinguishable on the side commonly imprinted so that they may be readily commingled and shuffled as a deck of cards.

The selector card 64A shown in FIG. 1 is provided with indicia imprinted as respective digits 98 arrayed in various regions 96 appearing on the face 66 of the card 64A. Each respective digit 98 defines a category appearing on a corresponding question and answer card 94.

Referring now to FIG. 12, a question and answer card 94A is shown particularly adapted for use with the selector card 64A shown in FIG. 1. For example, card 94A contains a series of mated question and answer pairs 100, different pairs being provided for each category on the selector card 64A. In this regard, it may be understood that a category is represented by the digit 98 or other indicia appearing in region 96 appearing on the face 66 of selector card 64, such that the categories shown on selector card 64 are represented by the numerals "3" and "4". The corresponding categories on question and answer card 94A are D-3 and D-4. Thus, the digit "3" appearing on one region 96 of face 66 is indicative of a three letter word, while the digit "4" is representative of a four letter word. It is to be understood that other digits could be substituted whereby, for example, the digits "5" and "6" could be substituted or added, whereby five and six letter words would appear as answers on the corresponding question and answer cards 94A.

To play the game, the participants choose the first game master and take their positions around game board 22. If more than 4 players were to participate when using the game board shown in FIG. 1, the players would form teams, chosing a captain to announce the team's answer to a given question. If playing as teams, the players would sit in the same area as the other team players. Thus, the game master would be positioned adjacent end 34 and preferably with point 36 directed towards the game master(s) who are responsible for asking the questions. Other players would sit adjacent their respective sides 28, 30 and 32.

The order of play is then decided by the game master placing die 70 in cup 78 and throwing the die whereby the face of die appearing uppermost, shown in FIG. 2 as face 76, bearing the color corresponding to the respective player at each position 28, 30 and 32, would go first. Other answering players would follow, determined either by their position clockwise or counterclockwise around game board 22 from the first answering player, or by subsequent throws of the die 70 by the game master. Tokens 80, 82 and 84 are then placed in the recesses 52 in respective start areas 44, whereby each player may begin play at a common start area on their respective paths 38, 40 and 42. At the same time, the game master may combine bonus cards 90, penalty cards 92 and question and answer cards 94, shuffling the bonus cards 90, penalty cards 92 and question and answer cards 94 together whereby a random sequence of the cards 90, 92 and 94 is arranged in a single deck.

The game then proceeds by the first player (team) spinning indicator arrow 62 around spindle 60 so that arrowhead 102 points to a specific region 96 on face 66 of selector card 64A. When the arrowhead 102 of indicator arrow 62 stops and points on a specific region 96, the game master asks the first player a question from the question and answer card 94A which corresponds to the category thus randomly selected. For example, when the indicator arrowhead 102 points to the digit "4" on face 64, the game master would then ask an answering player a question from the four letter question and answer pairs 100 appearing on question and answer card 94A. If the player provides a correct response, the player advances the player's marker token 80, 82 or 84, as appropriate, one space forward, for example, from start 44 to intermediate space 48 as shown in FIG. 1.

When the game master asks the question from the question and answer pair 100 appearing on the respective question and answer card, the answering player then has 30 seconds to give the correct answer to the question corresponding in the mated question and answer pair 100. The appropriate interval of response is determined when, after the game master asks the question from the mated pair 100, timer 88 is inverted and the player is then given the period until all the sand in the hourglass shaped timer 88 has passed through its neck to respond to the question within the allotted time is deemed an incorrect answer. Preferably, the player is given only one opportunity to provide a correct answer.

If the answering player gives the correct answer, that player advances his or her marker token 80, 82 or 84, as appropriate, forward one space and may continue the answering player's turn by spinning the wheel again and providing further answers until an incorrect response is given. When the first player (team) provides an incorrect answer, that player or team loses its turn and the turn then goes to the next answering player (team). However, before the second player (team) begins that player's turn, any other player (not including the answering player (team) that answered incorrectly previously), may raise a hand and attempt to answer the question correctly. If answered correctly, that answering player (team) may move ahead two spaces. In any event, the next turn still goes to the answering player (team) that was second as determined by the original toss of the die or by moving clockwise from the first answering player (team).

If, during a game, a bonus card 90 is pulled by the game master, the respective answering player having the current term may move forward one space without the necessity of responding to a question. If, on the other hand, a penalty card 92 is pulled by the game master, the player must move back one space, but may nonetheless continue the turn. The inclusion of the bonus and penalty cards provides an element of chance in the game and tends to add more recreational flavor to the game hereof.

When there is more than one player on a team, the answering players must elect a captain of the team, and that captain is the only person who can answer the question asked by the player who is the game master, although all members of a team may collaborate and agree on their responsive answer prior to the captain of the team announcing the answer to the game master.

Also included on the game board 22 are a plurality of penalty areas 50. In the event an answering player answers out of turn, that player or team must move their marker token 80, 82 or 84 to their respective penalty area 50. In order to depart from the penalty area, that player or team captain must answer correctly on that player's next turn. If answered correctly, the player or team may move its marker token 80, 82 or 84 out of the penalty area 50 and back to the starting space 44 and continue their turn.

In the preferred embodiment hereof, different selector cards 64 may be substituted to provide different faces 66 for indicating different groups of categories to be asked. For example, the board game hereof may be used as an educational game for teaching mathematics, and in particular arithmetic, by use of different question and answer cards 94, such as question and answer card 94B shown in FIG. 13. Thus, spindle 60 may be removed from game board 22 by pressing inward on spindle 60, thereby permitting it to be removed from aperture 58 and hole 68. Thereafter, any of the selector cards 64, such as 64A, may be replaced with selector card 64B shown in FIG. 9, having a plurality of different regions 96, a different mathematical symbol such as +, −, × and ÷ indicating each different category corresponding to a separate region 96. Thereafter, the spindle may be replaced and the indicator arrow 62 repositioned over the spindle 60 whereby the arrow may be manually manipulated to spin and thus randomly determine a category of question to be asked. For example, when arrowhead 102 points to a plus sign on the face 66 of selector card 64B, the game master would ask an addition question from card 94B, the answering player being given the question portion of the mated pair 102, such as "18 +22 " by the game master, and then the answering player would be expected to respond with the correct arithmetical answer. In all other respects, the game would be played as set forth hereinabove.

Yet further, the game could be played as a foreign language game, using a selector card 64C such as shown in FIG. 10. When selector card 64C is used, the various nationality symbols 106 representing different foreign languages may be displayed on the face 66 of the selector card 64C, with one symbol 106 corresponding to each region 96 appearing thereon. The selector card 64C would be replaced as described hereinabove for any other selector card 64 and the indicator arrow 62 spun so that arrowhead 102 would point to a symbol, such as a flag, corresponding to a foreign language. For example, as shown in FIG. 10, symbols for the countries of English, French, Spanish, Italian and German could be shown by their various flags appearing as symbols 106 on selector card 64C. If the arrow points to the flag corresponding to the English language, such as the United States or the United Kingdom, an English word would be given to the answering player by the game master, with the answering player expected to respond with a foreign word meaning the same. Similarly, if the arrowhead pointed to a region having a symbol, such as the German flag corresponding to the German language, the answering player must answer with the English word corresponding to the foreign word, such as is displayed on the question and answer card 94C. Thus, question and answer card 94C would comprise one of a set corresponding to selector card 64C, with each symbol 106 as shown in FIG. 10 indicating a separate category within a group of such categories. In all other respects, the foreign language game would be scored and played as set forth hereinabove with respect to selector card 64 for the educational game 20 of the present invention.

In yet a further embodiment, the educational game 20 may be played as a literature game, using selector card 64D. When used as a literature game, for example, selector card 64D would be divided into a plurality of different regions 96, each region including the name of a book or the name of an author, such as "King", "Dickens", etc., shown by indicia 108 on selector card 64D. A separate set of question and answer cards 94D, as shown in FIG. 15, would be used in conjunction with selector card 64D appearing in FIG. 11. The selector card 64D would be used in place of any of the other selector cards 64 and play initiated as set forth hereinabove. When arrowhead 102 was spun and landed on a particular author's name, such as "Dickens", the game master would ask the answering player whose turn it then was to provide the title of a book written by that author, such as a book beginning with a particular letter. If the answering player gave the correct response, such as, in this case, "A Christmas Carol", the player would advance one space and continue his or her turn. In all other respects, the game would be played as set forth hereinabove corresponding to selector card 64.

It may be appreciated that, as opposed to providing a question and answer pair for each category on a single card, a separate set of question and answer cards 94 might be provided for each category. In such circumstances, the answering player would first spin the indicator arrow, and when the category had been randomly selected by the indicator arrow pointing to a corresponding region 96, the questioning player or game master would then draw a card from the appropriate set corresponding to that category and ask the player a question from among the possible question and answer pairs listed on the particular card 94.

It is to be understood that many variations might be employed in conjunction with the novel educational game 20 I have described hereinabove without departing from the spirit and disclosure of the preferred embodiment of the invention set forth hereinabove. Therefore, my intention is intended only to be limited only by the scope of the claims as set forth hereinafter.

I claim:

1. An educational board game for use by a questioning player and a plurality of answering players where the winner is determined by one of a plurality of answering players advancing from a start to a finish area, said game comprising:

a game board having a playing surface defined on a base surface thereof, said playing surface presenting indicia separating said surface into a plurality of individual progress paths, one of said paths for each answering player, each said path including a start area, a plurality of intermediate areas, and a finish area, and a master region corresponding to a questioning player;

manually manipulable rotatable chance means operatively associated with said game board;

means for marking each player's progress along said path;

random question-selector means comprising manually manipulable rotatable indicator means and a plurality of commonly sized, interchangeable faces, each of said interchangeable faces presenting a plurality of discrete regions for cooperatively selecting a question thereby to be asked by said questioning player, each of said faces including structure defining an aperture therethrough for receiving a normally vertical indicator means stem; said indicator means being rotatable about said stem;

a plurality of sets of substrates, one set of said substrates corresponding to each of said interchangeable faces, each said substrate bearing a plurality of question and corresponding answer indicia pairs thereon, each of said pairs corresponding to one of said question-selector regions;

each said question and answer substrate being of a uniform size; and timing means for determining the permissible interval for a response to an asked question.

2. An educational board game as set forth in claim 1, said game board including structure defining an aperture therethrough for receiving said stem and an area for receiving one of said interchangeable faces thereon.

3. An educational game comprising:

(a) a game board having a playing surface including:
structure defining a plurality of sides, for positioning a plurality of different questioned players,
structure defining an end for positioning of a game master and a master area juxtaposed thereto,
a plurality of individual paths corresponding to each questioned player defined on said surface, each path including a start area, a finish area, and a plurality of intermediate areas;

(b) question-selector means including a face presenting a plurality of different question category spaces and indicator means for randomly selecting one of said category spaces;

(c) a set of question and answer cards, each of said cards including a plurality of mated question and answer pairs, at least one of said pairs corresponding to each of said different category spaces, (d) marker means for indicating each questioned player's progress along said path;

(e) timer means for receiving a questioned player's answer; and (f) structure defining an aperture through said board and means for removably and rotatably mounting said indicator means to said game board through said aperture.

4. An educational game as set forth in claim 3, wherein said face includes structure defining a hole therethrough for alignment with said aperture.

5. An educational game as set forth in claim 4, wherein said rotation enabling means comprises a spindle removably mounting said indicator.

6. An educational game as set forth in claim 5, including a plurality of separate faces, each said face presenting a different group of category indicia and including a plurality of sets of question and answer cards, each of said sets of cards corresponding to one of said groups.

7. An educational board game as set forth in claim 6, one of said sets including mathematical question and answer indicia.

8. An educational board game as set forth in claim 7, one of said sets including English language question and answer indicia.

9. An educational board game as set forth in claim 8, one of said groups of category indicia including symbols corresponding to different foreign languages.

10. A method of playing an educational board game for a questioning player and a plurality of answering players, said method including:

positioning a marker token for each of said answering players at respective start areas of a game board presenting a surface defining a plurality of paths, each of said paths corresponding to an answering player and including a start area, a finish area, and a plurality of intermediate areas;

sequentially actuating chance generating means for selecting the order of play among said answering players;

actuating random category selector means to randomly select a category of questions and answers;

selecting a question and answer card bearing a plurality of mated question and answer indicia pairs;

said questioning player asking a question of said mated pair corresponding to a randomly selected one of said categories;

actuating a timer means for determining the interval within which an answering player may answer said question after said question is asked;

a selected first answering player answering said question;

said answering player repositioning said player's marker token forwardly toward said finish along said player's path for each answer corresponding to the selected answer indicia mated to said question, or alternatively toward said player's start for each answer not corresponding to the selected answer indicia mated to said question;

repositioning an answering player's marker token to a penalty area defined on said surface of said game board when said answering player answers out of the selected order of play; and successively repeating said steps of actuating random selector means, selecting a question and answer card, asking a question and repositioning said marker token until one of said answering player's tokens is repositioned into said player's finish area.

* * * * *